United States Patent [19]

Bianco

[11] Patent Number: 4,821,443

[45] Date of Patent: Apr. 18, 1989

[54] RECOIL ABSORBER

[76] Inventor: Rodolfo Bianco, 560 West 21st Avenue, Vancouver, British Columbia, Canada, V5Z 1Y7

[21] Appl. No.: 217,589

[22] Filed: Jul. 11, 1988

[51] Int. Cl.[4] ..... F41C 29/00

[52] U.S. Cl. ..... 42/94

[58] Field of Search ..... 42/94; 89/37.04

[56] References Cited

U.S. PATENT DOCUMENTS 3,012,350 12/1961 Wold ..... 42/94

4,558,531 12/1985 Kilby ..... 42/94

*Primary Examiner*—Charles T. Jordan

*Attorney, Agent, or Firm*—Townsend and Townsend

[57] ABSTRACT

A recoil absorber for use with a rifle comprising a base compartment and an upstanding compartment mounted to the base compartment. Each of the compartments has flexible walls to define an interior that is substantially filled with particulate material of high density. The flexible walls of the upstanding compartment are connected by a central upstanding internal baffle extending therebetween. The baffle forms the upstanding compartment into two lobes defined by a central upstanding channel for accepting a butt of a rifle.

4 Claims, 1 Drawing Sheet

RECOIL ABSORBER

FIELD OF THE INVENTION

This invention relates to a recoil absorber for absorbing the recoil force of a discharged rifle.

DESCRIPTION OF THE PRIOR ART

The problem of recoil has long been known as a serious impediment to the full enjoyment of high powered rifles as recreational tools. The recoil force of a rifle tends to compound the problem of flinching by the shooter, and in the case of rifles heavier than .30 caliber, the recoil force often leaves the shooter's shoulder black and blue.

The average hunter who uses a high powered rifle for hunting may visit the shooting range only once a year prior to hunting season in order to "sight-in" or check the accuracy of his gun. Because this test firing is usually done from a sitting position at a stationary bench where felt recoil is much higher than in any other position, most owners of high powered rifles fear and try to avoid this yearly encounter with recoil and bruised shoulders. This results in inadequately sighted rifles and fear of the gun's recoil in hunting situations resulting in poor aim and missed shots.

In the past many attempts have been made to reduce the recoil of rifles.

Bennett in U.S. Pat. No. 3,335,515 discloses an anti-recoil device for a gun that comprises a cavity filled with a high specific gravity fluid such as mercury formed in the stock of the gun. The fluid tends to remain fixed in space as the weapon moves in recoil thereby providing an opposite force to reduce the recoil.

Eastin in U.S. Pat. No. 3,491,473 teaches a cushioned gun stock that uses a collapsible corrugated section with internal shock-absorbing means to lessen the recoil felt by the marksman.

Farrar in U.S. Pat. No. 4,683,671 discloses a very simple recoil shock pad of yieldable material having an internal cavity filled with padding. The device is attached to the end of a gun stock by screw fasteners.

Other prior art solutions to the problem of recoil include the recent introduction of so-called muzzle brakes which vent escaping gases radially through ports milled near the muzzle of the barrel. Such a device has helped to reduce recoil to some extent.

Unfortunately, the use of these prior art devices is not universally accepted. Some shooter's argue that the muzzle brakes are unsightly and that they alter a gun's characteristics irrevocably. Furthermore, in a hunting situation, it is felt by some that these devices are of no value anyway, as no recoil is felt when one is concentrating and intent on shooting a moving target.

Nonetheless, the problem of unacceptable recoil when shooting from a stationary bench during the "sight-in" process remains.

For many years, shooters have used small sandbags, placed between the butt of the gunstock and the shoulder to reduce or spread the recoil force over a wider area of the shoulder when "sighting-in". Such a system suffers from the disadvantage that the sandbags must be continually repositioned between the gun and the shoulder between shots. As well, the rounded surface of a sand bag and the gun stock resting against it tend to roll away from each other as the gun is fired deflecting the gun off target.

U.S. Pat. No. 3,935,657 to Wade discloses a rifle rest comprising a rectangular block having notches cut along two adjacent sides in which a rifle can be rested to steady the gun for aiming instead of a sand bag. This device is primarily a sighting tool and does not address the problem of recoil.

SUMMARY OF THE INVENTION

Accordingly, there is a need for a recoil absorber that overcomes the disadvantages of the prior art previously mentioned.

The recoil absorber of the present invention comprises;

a base compartment; and an upstanding compartment mounted to said base compartment, each of said compartments having flexible walls to define an interior that is substantially filled with particulate material of high density, the flexible walls of said upstanding compartment being connected by a central upstanding internal baffle extending therebetween, said baffle forming said upstanding compartment into two lobes separated by a narrowed portion defining a channel for accepting a butt of a rifle, said lobes communicating with each other about said baffle.

BRIEF DESCRIPTION OF THE DRAWINGS

The recoil absorber is shown in the following drawings in which.

DESCRIPTION OF THE PREFERRED EMBODIMENTS

Figure 2:
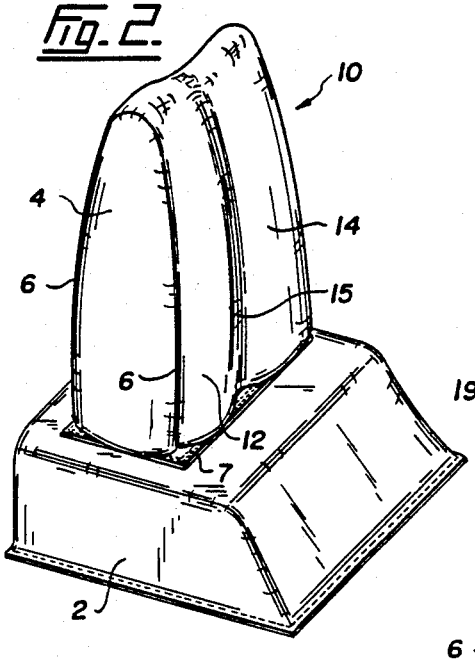
FIG. 2 is a pictorial view of the recoil absorber.

FIG. 2 shows a recoil absorber 10 according to a preferred embodiment of the present invention.

There is an essentially rectangular base compartment 2 upon which is mounted a upstanding compartment 4. Preferably these compartments are constructed from pieces of a flexible material such as leather that is sewn together along seams 6. The interior of the compartments are filled with a dense particulate material such as fine lead shot.

Figure 3:
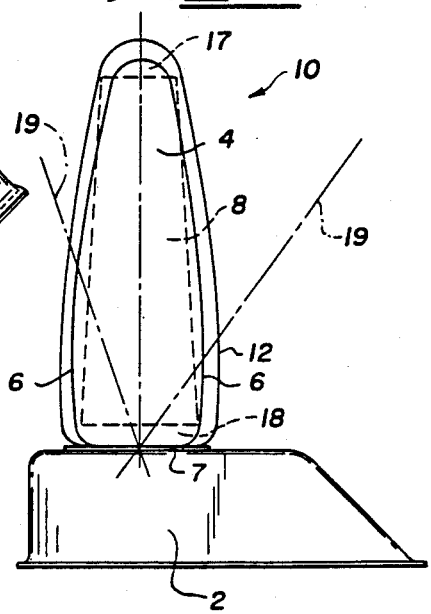
FIG. 3 is a side view of the recoil absorber.
Figure 4:
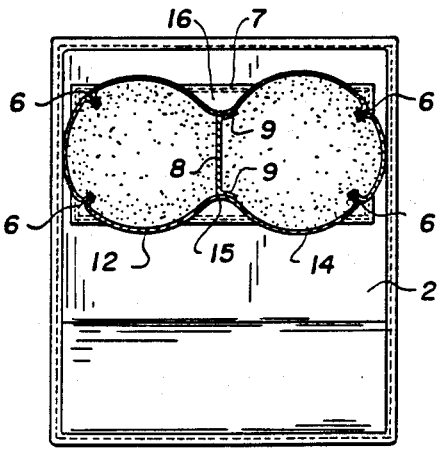
FIG. 4 is a top view of the recoil absorber.

The upstanding compartment 4 contains an internal baffle 8 as shown in FIGS. 3 and 4 to prevent the compartment from sagging or ballooning due to the weight of particulate material contained therein. Baffle 8 with folded side edges 9 has a width narrower than the width of the upstanding compartment 4. Sides edges 9 are attached in a suitable manner such as double lines of sewing to the inner walls of upstanding compartment 4 to form the compartment into a two lobes 12 and 14 separated by central vertical channels 15 and 16.

Internal baffle 8 does not extend completely through the interior of upstanding compartment 4. As best shown in FIG. 3, the interior of lobes 12 and 14 communicate with each other through internal openings 17 and 18 at the upper and lower ends of the upstanding compartment where internal baffle 8 does not extend completely through the compartment. The dense particulate matter located within upstanding compartment 4 is thus able to move freely between lobes 12 and 14. This free flow of particulate material allows compartment 4 to be tilted through various angles with respect to the base as shown by dashed lines 19 in FIG. 3. It should be noted that upstanding compartment 4 and base 1 do not communicate with each other, compartment 4 being attached atop base 2 at seam 7.

In use, the recoil absorber of the present invention is placed on a stationary bench. The dense particulate material of the absorber ensures that the unit provides a stable platform with the upstanding compartment adjustable to a variety of angles. The unit can be raised or lowered to an appropriate elevation by placing suitable spacing pieces such as wooden 2×4's or the like under base compartment 1.

Figure 1:
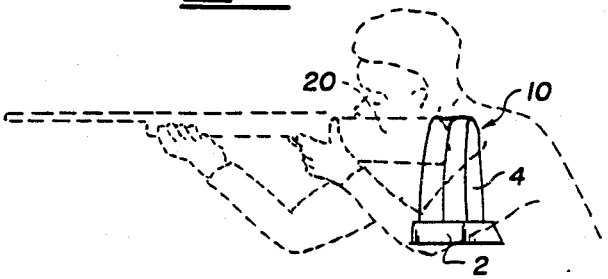
FIG. 1 shows the recoil absorber of the present invention in use.

If desired, the shooter stabilizes the gun on the bench with the usual aids. As shown in FIG. 1, the shooter moves the absorber behind the rifle butt 20 by tilting the upstanding compartment 4 such that the rifle butt is firmly planted in a central vertical channel 15 or 16. The shooter's shoulder is then applied to the opposite side of the upstanding compartment and the rifle is fired in the usual manner.

The mass of the recoil absorber closely applied to the gun effectively becomes part of the overall mass of the gun. By the Law of Conservation of Momentum, the greater effective mass of the gun greatly reduces the recoil velocity of the gun and hence the recoil force felt by the shooter.

The recoil absorber of the present invention allows the recoil of the gun to be reduced without any modifcation of the gun itself. The absorber is free standing and very stable and the upstanding compartment 4 will remain in the position to which it is tilted. The upstanding compartment can be applied against the butt of the gunstock leaving the shooter free to get up from the stationary bench without fear of the compartment or gun falling to the ground. The upstanding compartment can be tilted to any angle either toward or away from the gun butt. Thus the shooter may tilt the upstanding compartment back away from the gun butt and remove the gun from the bench for cleaning. When ready to shoot again, the shooter simply puts the gun back on the bench as before, tilts the upstanding compartment forward against the butt stock and resumes shooting. This arrangement is convenient and besides effectively reducing recoil frees the shooter from continually adjusting a single sand bag or piece of padding between the gun and shoulder.

The recoil absorber of the present invention provides a simple, safe, and inexpensive unit for better gun stability and shooting accuracy.

The embodiments of the invention in which an exclusive property or privilege is claimed are defined as follows:

1. A recoil absorber for use with a rifle comprising:

a base compartment; and an upstanding compartment mounted to said base compartment, each of said compartments having flexible walls to define an interior that is substantially filled with particulate material of high density, the flexible walls of said upstanding compartment being connected by a central upstanding internal baffle extending therebetween, said baffle forming said upstanding compartment into two lobes separated by a narrowed portion defining a channel for accepting a butt of a rifle, said lobes communicating with each other about said baffle.

2. A recoil absorber as claimed in claim 1 in which said central internal baffle has apertures to allow the lobes of said upstanding compartment to communicate with each other to allow for movement of said particulate material between said lobes such that tiltable movement of said upstanding compartment with respect to said base compartment is possible.

3. A recoil absorber as claimed in claim 1 in which said particulate material is fine lead shot.

4. A recoil absorber as claimed in claim 1 in which said flexible walls are formed from leather.

* * * * *